United States Patent [19]

Dietch

[11] 3,988,632

[45] Oct. 26, 1976

[54] BLACK-SURROUND COLOR PICTURE TUBE

[75] Inventor: Leonard Dietch, Skokie, Ill.

[73] Assignee: Zenith Radio Corporation, Chicago, Ill.

[22] Filed: May 24, 1973

[21] Appl. No.: 363,787

Related U.S. Application Data

[63] Continuation of Ser. No. 186,885, Oct. 6, 1971, abandoned.

[52] U.S. Cl. ..... 313/408; 313/402

[51] Int. Cl.[2] ..... H01J 29/07; H01J 31/20

[58] Field of Search ..... 313/85 S, 92 B

[56] References Cited

UNITED STATES PATENTS

| | | | |
|---|---|---|---|
| 3,146,368 | 8/1964 | Fiore et al. | 313/92 B |
| 3,590,303 | 6/1971 | Coleclough | 313/92 B |
| 3,614,503 | 10/1971 | Dietch | 313/92 B |

*Primary Examiner*—Robert Segal
*Attorney, Agent, or Firm*—John H. Coult

[57] ABSTRACT

A color cathode-ray tube having a phosphor screen including a pattern of red-emitting, blue-emitting and green-emitting phosphor deposits. Electron gun means generates first, second and third angularly spaced electron beams for exciting the phosphor elements. A parallax mask is disposed adjacent the screen and has a pattern of openings for causing the first, second and third electron beams to impinge exclusively on the red-emitting, blue-emitting and green-emitting phosphor deposits, respectively. The openings in the mask and the phosphor deposits are dimensioned relative to each other such that the beam spots formed through the mask openings and the respectively associated phosphor deposits have a relative dimensional difference which varies between the central portion and the peripheral portions of the screen from a condition in which the beam spots have a greater dimension than the associated phosphor deposits to a condition in which the beam spots have a dimension smaller than the associated phosphor deposits. The screen has light absorptive material between the phosphor deposits in at least those portions of the screen wherein the said beam spot dimension is larger than the associated phosphor deposit dimension.

7 Claims, 6 Drawing Figures

BLACK-SURROUND COLOR PICTURE TUBE

CROSS-REFERENCE TO RELATED APPLICATIONS

This application is a continuation of my copending application Ser. No. 186,885, now abandoned, filed Oct. 6, 1971, and is related to my U.S. Pat. No. 3,614,503, both assigned to the assignee of this application.

BACKGROUND OF THE INVENTION

The present invention relates to the form of tri-color shadow-mask tube popularly referred to as a black-surround tube. Such a tube is characterized by the fact that the phosphor dots which constitute the phosphor triads of the screen are reduced in size so as to be separated from one another as distinguished from being in tangential contact. A light-absorbing material, such as graphite, is deposited in the spaces which intervene the phosphor dots. In short, the individual phosphor dots are surrounded by a black material, giving rise to the term black-surround screen.

The preferred form of such a tube is described and claimed in U.S. Pat. No. 3,146,368 - Fiore et al, issued Aug. 25, 1964 and assigned to the assignee of the present invention. It has a unique dimensioning of the screen and mask, selected so that the electron beams are larger in cross-sectional area than the phosphor dots. This permits optimizing the improvement in brightness and contrast that inures from the black-surround construction. An alternative form, known commercially as a "matrix" tube, retains the relative beam to dot size of conventional shadow mask tubes in which the beam area is less than the phosphor dots. Where the beams and phosphor dots are of different sizes, with one larger in diameter than the other, there is an overlapping relation and the extent of overlap provides a guard band or tolerance to accommodate some amount of misregistration of the beam and dot without affecting purity. The tolerance is said to be positive where the phosphor dot is larger than the electron beam and is said to be negative where the phosphor dot is smaller. Both described forms of screen structure may exhibit the same guard band or tolerance range but the negative tolerance construction, featuring a larger beam than phosphor dot, is preferred since it accommodates a greater amount of light-absorbing material on the screen from which optimized conditions of contrast and brightness may be realized.

The present invention concerns still a third screen structure which evolves from developments directed to achieving performance results approaching that of the negative tolerance construction but with screening techniques closely resembling those utilized in fabricating the matrix screen structure.

Accordingly, it is an object of the invention to provide a shadow-mask type of tri-color cathode-ray tube having a novel black-surround screen structure.

BRIEF DESCRIPTION OF THE DRAWINGS

The features of the present invention which are believed to be novel are set forth with particularity in the appended claims. The invention, together with further objects and advantages thereof, may best be understood by reference to the following description taken in connection with the accompanying drawing, in the several figures of which like reference numerals identify like elements, and in which:

DESCRIPTION OF THE PREFERRED EMBODIMENT

Figure 1:
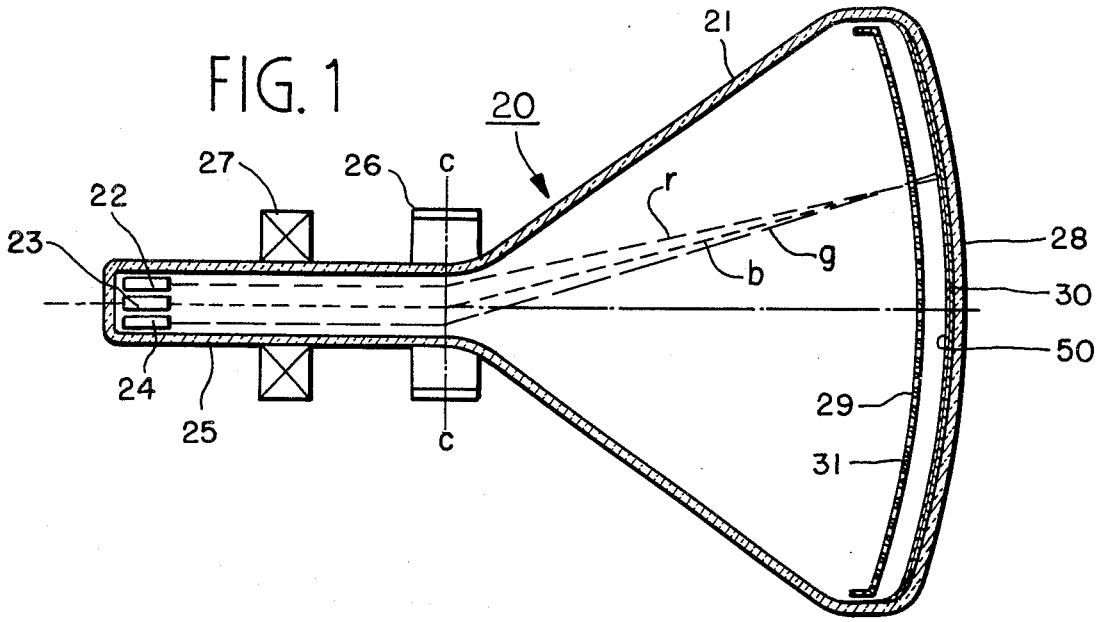
FIG. 1 is a cross sectional, partially schematic, representation of a tri-color shadow-mask picture tube.
Figure 2:
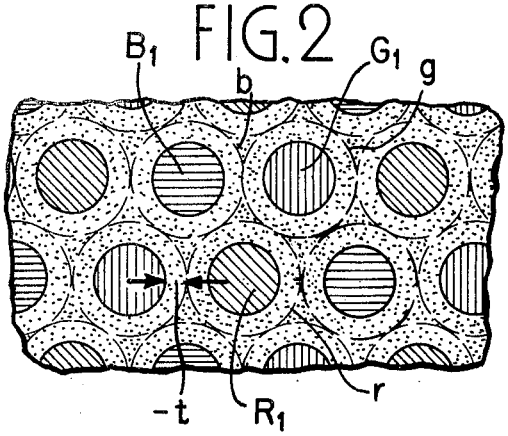
FIGS. 2 and 3 are enlarged fragmentary portions of different parts of the screen of the tube shown in FIG. 1.

The color cathode-ray tube 20 of FIG. 1 has a glass envelope 21 with a neck portion 25 enclosing a cluster of electron guns indicated schematically by rectangles 22, 23 and 24. These guns are conventional structures for developing three electron beams, *g*, *b* and *r* and for directing those beams to a mosaic image screen 30. The screen has a multiplicity of phosphor triads distributed in accordance with a repeating pattern over the image area and each triad consists of a deposit of green, a deposit of blue and a deposit of red phosphor as is well known in the art. The phosphors are applied to the inner surface of faceplate 28 of the tube envelope and are backed by the customary electron transparent aluminum layer 50. Between screen 30 and the gun cluster is a shadow mask 29 disposed across the paths of the electron beams but positioned close to and in essentially parallel relation with the screen. As usual, the shadow mask has apertures corresponding in number to, and arrayed in accordance with the same distribution pattern as, the triads constituting screen 30 and each aperture of the mask is aligned with an assigned one of those triads. Usually, the phosphor deposits are essentially circular and the holes of the mask are likewise circular although other shapes for the phosphor deposits and/or the apertures are known and are useful. The apertures of the mask may be of uniform diameter although generally and preferably they are graded, decreasing in diameter with distance from the center of the screen. Important details of the screen and the mask, introduced in practicing the invention, will be discussed more particularly hereafter. Between the gun cluster and mask 29 is a convergence assembly 27 and a deflection yoke 26. As thus far described, the structure of FIG. 1 is a form of tri-color shadow-mask tube which functions under the influence of scanning fields established by yoke 26 to scan screen 30 and synthesize an image in color corresponding to the video information of a received color broadcast.

Where the shadow-mask tube is to be of the negative-tolerance black surround variety, its screen 30 and its beam-dot dimensioning are in accordance with the detail of FIG. 2 which is an enlarged representation of a fragmentary portion of the screen. One of the phosphor triads is represented by the crosshatched circles $G_1$, $B_1$ and $R_1$. The mottling around the indicated phosphor deposits connotes a light-absorbing material or black surround which fills the parts of the screen that separate the phosphor dots from one another. The broken-line circles *g*, *b*, *r* arranged concentrically with the phosphor deposits indicate the three electron beams *g*, *b* and *r*. The dimension $-t$ indicates the extent to which the electron beams overlap the phosphor deposits providing a guard band. As explained above, this is regarded in the art as a negative tolerance.

Screening the structure of FIG. 2 is now well understood in the art and usually the light-absorbing material is applied before the application of the phosphor dots. A suitable process for laying down the light-absorbing material is disclosed in U.S. Pat. No. 3,558,310 to Mayaud. It entails utilizing the mask as a pattern in photographically printing clear dots of polyvinyl alcohol (pva) over each elemental area of the screen that is ultimately to receive phosphor. Thereafter, a slurry containing light-absorbing material is applied all over the screen and affixed. Following this, a chemical agent or stripper, such as hydrogen peroxide, is applied to the screen to remove the previously formed deposits of pva. At this juncture the screen has a grille of graphite or other black material with holes into which phosphor is deposited, again employing the mask as a pattern in a photographic printing process, utilizing a water soluble photosensitive resist of pva and the phosphor in process.

Since the phosphor deposits are to be smaller in area than the cross sectional area of the electron beams, it is preferred that the shadow mask be prepared with apertures dimensioned so that photographic printing of the clear pva dots establishes the phosphor deposits on the screen surface to the desired dimension. Thereafter, in accordance with the teachings in U.S. Pat. Nos. 3,666,462; 3,669,771; and 3,702,277, (all assigned to the assignee of the present invention), the shadow mask is re-etched or chemically milled to enlarge its apertures to a predetermined final size. They are opened up to the extent necessary that the electron beams, which are dimensioned by passage through the holes of the mask, provide the desired guard band $-t$ of FIG. 2. Of course, other arrangements including optical reduction and the like are available for printing phosphor dots that are smaller in area than the electron beams. A variety of choices are known and available.

Figure 3:
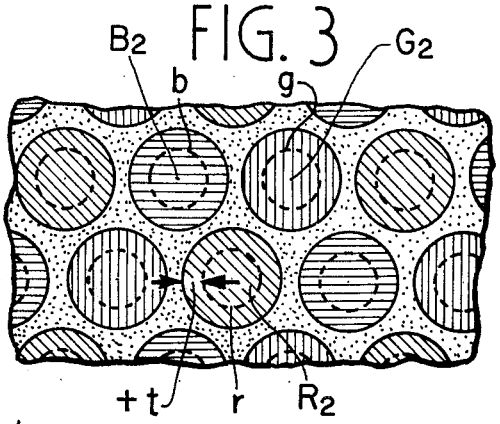
Figure 4:
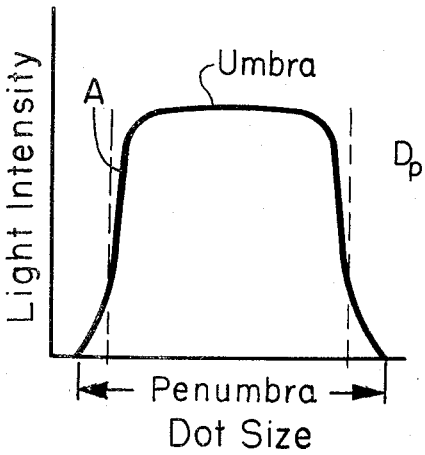
FIGS. 4 and 5 are curves used in explaining exposure techniques.
Figure 5:
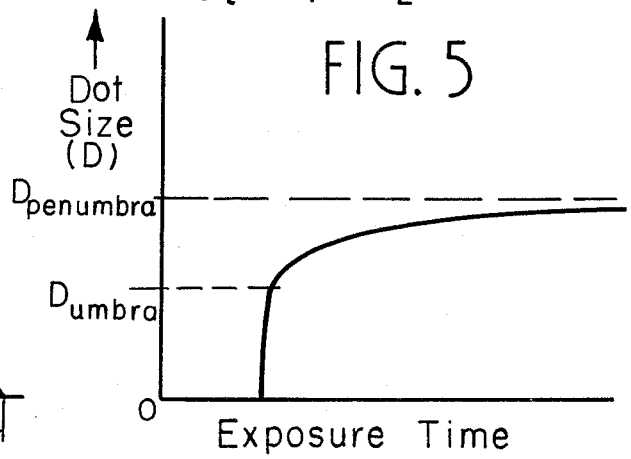
Figure 6:
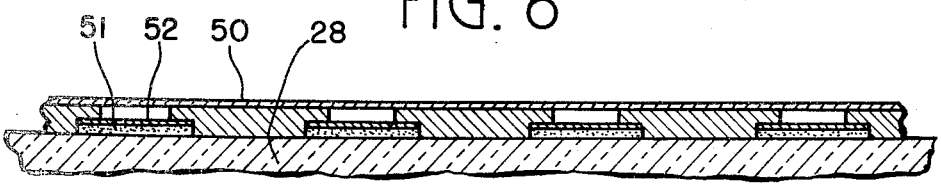
FIG. 6 is an enlarged cross sectional view of a part of the screen of the tube shown in FIG. 1.

FIG. 3 is a similar representation of a fragmentary portion of a matrix tube having an illustrative phosphor-dot triad $G_2$, $B_2$, $R_2$. In this case the tolerance is designated $+t$ since the phosphor dots are larger in area than the electron beams. In fabricating this screen structure, the light-absorbing or black surround is applied in the same way as discussed in connection with FIG. 2 except that the shadow mask in this instance has the same aperture size when used in screening as in the final installed condition within the tube; in short, the apertures are not enlarged after screening. This is, of course, possible since in photoresist screening with pva or other similar colloid that is rendered insoluble upon exposure of actinic energy, the insolubilized area may conveniently be made greater than the area of the mask aperture through which the exposing light impinges upon the screen in the photoprinting process. This will be understood with reference to the curve of FIG. 4 which relates dot size to light intensity. The broken-construction lines 1 represent the geometrical projection on the screen surface of an aperture of the mask with a point light source, whereas the full-line curve A shows the modification imposed by the fact that a finite light source is used. In other words, a finite light source introduces umbra penumbra effects by virtue of which the size of the exposed area may vary between two extremes one of which is the umbra while the other is the penumbra, indicated in the drawing by the legends D umbra and D penumbra, respectively, where D designates dot diameter. The actual insolubilized area has a dimension within these extremes which may be controlled by variation in light intensity and/or exposure time. As indicated in FIG. 5, a certain minimum exposure time is required to effect insolubilization of the pva which, of course, is necessary to achieve any deposit. This exposure is a function of light intensity and time and further depends on whether the photosensitized coating layer in process is clear pva, referred to in developing the grille of light-absorbing material, or is a pva composition including a phosphor ingredient utilized in applying phosphor. Generally, clear pva has the shortest minimum exposure. After the minimum exposure time has been exceeded, assuming a reference value of light intensity, the dot size increases with exposure in the manner of FIG. 5 from the umbra value which is less in area than the aperture of the mask to the penumbra value which exceeds the mask aperture in area.

Accordingly, in screening the arrangement of FIG. 3, the dots of clear pva used to protect selected areas of the screen from receiving the light-absorbing material are dimensioned to be larger in area than the projected apertures of the mask on the screen. Consequently, when the phosphor is subsequently deposited in the holes provided in the grille, the formed phosphor dots are larger in area than the cross section of the electron beams as required to establish the tolerance $+t$. Actually, the amount of tolerance $t$ in FIG. 3 may be the same as that in FIG. 2.

If the screen structure of the type shown in FIG. 3 is arranged so that the holes in the grille are reduced in size, which would of course increase the screen area available to receive light-absorbing material to improve contrast and more closely approach the performance of the negative-tolerance black surround tube, the performance characteristics of the screen would deteriorate in certain respects. The light output would decrease because of the reduced size of the phosphor deposits. White uniformity would probably be degraded in the peripheral areas of the screen due to differential beam clipping. At the same time, however, there would be an improvement in purity reserve because of the increased separation of the dots from one another and there would be an improved screen reflectivity in view of the reduced area of exposed phosphor, that is to say, the reduced elemental areas of the screen surface on which phosphor is deposited.

The present invention offers a unique way to improve color tubes through their screen structures. In particular, it makes use of both positive and negative tolerances in what may be regarded as a type of hybrid screen structure having one portion of the screen arranged in the manner of FIG. 2 in which the spacing of the mask from the screen and the size of the apertures of the mask are related to the size of the phosphor dots of the triads to cause the electron beams to be larger in cross sectional area than the phosphor deposits. At the same time, another portion of the screen is constructed in accordance with the representation of FIG. 3 with the inverse dimensional relation, namely, with the phosphor deposits larger in area than the electron beams. More specifically, the negative tolerance structure of FIG. 2 constitutes the central portion of the screen while the positive tolerance structure of FIG. 3 constitutes the peripheral, especially the corner, portions of the screen. There may be an intermediate portion of essentially zero tolerance, that is to say, phosphor dots and electron beams of essentially the same size. This change in the sense of the tolerance across the screen may be accommodated by the mask grading and by exposure control which determines the effective phosphor dot size. Indeed, a practical embodiment of the screen may feature phosphor dots as arranged in conventional (non-black surround) shadow-mask tubes in conjunction with a graded mask, again as used in such conventional shadow-mask tubes.

By way of illustration, a screen-mask combination in accordance with the invention may have the following parameters:

| | LOCATION | |
|---|---|---|
| | Center | Corner |
| mask transmissivity | 20% | 10% |
| beam % of area, each color | 22 | 11 |
| dot % of area, each color | 20 | 20 |

In this execution of the present screen concept, the transmission of the grille for each color field may be constant from the center to the corners of the screen and be substantilly equal to the transmission at the center of the shadow mask; illustratively, it may be 20 per cent. This simply means that in printing the clear pva dots, preparatory to developing the light-absorbing grille, the exposure is controlled to dimension the clear pva dots such that when they are removed to form the holes in the grille for receiving phosphor, the holes provide the selected per cent transmission, 20 per cent for the assumed case in which it has been assumed that the central portion of the mask likewise is 20 per cent transmissive. Having prepared the grille with these holes, the various phosphor dots are printed in conventional manner of such dimension that they are in tangential contact with one another over the screen surface. It will be recognized that the portion of each phosphor dot that is predominantly effective in image reproduction is that which is exposed to the image screen through its associated grille hole. The remaining portion of each phosphor dot overlaps the grille and, without more, contributes little if anything to image reproduction although some portion of the light generated by phosphor overlapping the grille can be captured and utilized in a manner presently to be described.

With the screen prepared in the above-described way, a negative tolerance condition exists in the center of the screen which, in view of the aperture grade of the mask, changes to a positive tolerance at the corners. It has the advantages of higher brightness than commercial forms of the matrix tube and simplification over the negative-tolerance black surround tube. The brightness increase is made possible because the screen has a greater black area so that higher transmissivity glass may be employed without loss of contrast. For example, the glass transmissivity may be increased from 69 to 85 per cent. The simlification results from the fact that conventional masks, such as those suitable for non-black surround tubes, are employed rather than special masks and, additionally, except for the grille forming, the screening process is the same as for non-black surround tubes. It is not necessary to resort to the etch-back or re-etch process at all. Very acceptable levels of light ouput and contrast are attainable and the purity reserve is acceptable.

With a screen of this hybrid character, there tends to be a loss of light output due to the reduced size of the effective portions of the phosphor dots. This may be partially overcome and the light output increased by further providing the screen with a light-diffusing material 52 located in the space between the aluminum backing layer 50 and the light-absorbing material 51. The application of light-diffusing material to a black-surround screen is described and claimed in the above-identified Dietch patent. A simple process for adding such material is to apply it as an overcoat to the layer 51 of light-absorbing material which covers the screen area and the clear dots of pva in preparing the grille. It is only necessary that the material have the desired light-reflecting properties and also permit the chemical agent or stripper to permeate to the pva dots in order that these dots with the superposed layers of light-absorbing and light-reflecting material may be removed so that elemental areas of the screen are exposed to receive the phosphor deposits.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A shadow mask color cathode-ray tube comprising:

a mosaic screen of phosphor triads distributed in accordance with a predetermined pattern over an image area and individually including a deposit of green-emitting phosphor, a deposit of blue-emitting phosphor and a deposit of red-emitting phosphor;

beam generating means for developing three electron beams and for directing said beams to said screen;

and a shadow mask disposed across the paths of said beams in the space between said screen and said beam generating means having spot-forming apertures corresponding in number to, and arrayed in accordance with the same distribution pattern as, said triads with each aperture aligned with respect to an assigned one of said triads, the beam spots and the respectively associated phosphor deposits having a relative size difference which varies between the central portion and the peripheral portions of the screen from a condition in which the beam spots are larger than the associated phosphor deposits to a condition in which the beam spots are smaller than the phosphor deposits.

2. A color tube in accordance with claim 1 in which the phosphor deposits of said triads are generally dot shaped and the apertures of said mask are approximately circular.

3. A color tube in accordance with claim 2 in which in the central portion of said image area the beam spots are larger than the phosphor deposits and in which in the peripheral portions of said image area the beam spots are smaller than the phosphor deposits.

4. A color tube in accordance with claim 3 in which the beam spots are the same size as the phosphor deposits over a third portion of said image area intermediate said central portion and said peripheral portions thereof.

5. A color tube in accordance with claim 2 in which the phosphor dots of each of said triads are spaced from and are out of contact with one another and in which a light-absorbing material covers the screen areas between said phosphor dots.

6. A color tube in accordance with claim 5 in which said screen is backed by a light-reflecting layer and a light-reflecting material is positioned in the space between said layer and said light-absorbing material.

7. In a color cathode-ray tube, the combination comprising:

a phosphor screen comprising a repeating pattern of triads of red-emitting, blue-emitting and green-emitting phosphor deposits;

beam generating means for generating first, second and third angularly spaced electron beams for exciting said phosphor deposits;

a shadow mask disposed adjacent said screen and having a pattern of openings associated with said pattern of triads of phosphor deposits for causing said first, second and third electron beams to impinge on said red-emitting, blue-emitting and green-emitting phosphor deposits, respectively;

said openings in said mask and said phosphor deposits being dimensioned relative to each other such that the beam spots formed through said mask openings and the respectively associated phophor deposits have a relative dimensional difference which varies between the central portion and the peripheral portions of the screen from a condition in which the beam spots have a greater dimension than the associated phosphor deposits to a condition in which the beam spots have a dimension smaller than the associated phosphor deposits, said screen having light-absorptive material between said phosphor deposits in at least those portions of the screen wherein said beam spot dimension is larger than the associated phosphor deposit dimension.

* * * * *